US006149570A

United States Patent [19]

Lowe et al.

[11] Patent Number: 6,149,570

[45] Date of Patent: Nov. 21, 2000

[54] SELF-RETAINING ROTOR LID

[75] Inventors: Winston H. H. Lowe, Sunnyvale; Derek G. Petch, Los Gatos, both of Calif.

[73] Assignee: Beckman Coulter, Inc., Fullerton, Calif.

[21] Appl. No.: 09/255,913

[22] Filed: Feb. 23, 1999

[51] Int. Cl.[7] ..... B04B 7/06; B04B 5/02

[52] U.S. Cl. ..... 494/12; 494/16

[58] Field of Search ..... 494/12, 16, 20, 494/33, 60, 64, 85

[56] References Cited

U.S. PATENT DOCUMENTS

| | | | |
|---|---|---|---|
| 3,819,111 | 6/1974 | Romanauskas | 494/16 |
| 3,901,434 | 8/1975 | Wright | 494/16 |
| 3,961,745 | 6/1976 | Wright | 494/16 |
| 3,990,633 | 11/1976 | Stahl et al. | 494/16 |
| 4,360,151 | 11/1982 | Cowell et al. | 494/16 |
| 4,753,631 | 6/1988 | Romanauskas | 494/12 |
| 4,850,951 | 7/1989 | Cheng et al. . | |
| 5,344,380 | 9/1994 | Chern et al. | 494/12 |
| 5,512,030 | 4/1996 | Barkus | 494/16 |
| 5,562,554 | 10/1996 | Carson | 494/12 |
| 5,897,482 | 4/1999 | Lowe | 494/16 |

FOREIGN PATENT DOCUMENTS

| | | | |
|---|---|---|---|
| 2907001 | 8/1979 | Germany | 494/16 |
| 2907789 | 8/1979 | Germany | 494/12 |

*Primary Examiner*—Charles E. Cooley
*Attorney, Agent, or Firm*—William H. May; Margaret A. Kivinski

[57] ABSTRACT

In a centrifuge rotor assembly, a self-retaining rotor lid which is designed to stay on the rotor even when the lid is not tied down or secured to the rotor. The lid has a lip formed on an outer edge of the major side of the lid that faces the open end of the rotor body. The height of the lip is such that the lip extends beyond the edge of the open end of the rotor body. The lip has a diameter that is nominally smaller than the diameter of the open end of the rotor body, thus establishing a clearance therebetween. The clearance allows easy engagement of the lid to the rotor body, but is small enough to prevent the lid from tilting, which keeps the lid on the rotor even when the lid is not secured during centrifugation.

16 Claims, 3 Drawing Sheets

SELF-RETAINING ROTOR LID

TECHNICAL FIELD OF THE INVENTION

The present invention relates to centrifuge systems and more specifically to a self-retaining rotor lid.

BACKGROUND OF THE INVENTION

Large centrifugation systems typically use a rotor for holding sample containers which contain the sample to be separated. The rotor is covered by a rotor lid and then placed into an instrument chamber wherein the rotor is spun during centrifugation. Typically, the instrument chamber is evacuated for the centrifugation run to reduce the effects of windage and heat generation.

A problem that sometimes occurs in the operation of these centrifugation systems is that the centrifuge operators, either through haste or inattention, sometimes neglect to tighten down or secure the rotor lids to the rotor assembly. Thus, when the rotor is spun during centrifugation, the rotor lid can be thrown off by the centrifugal force of the spinning rotor. Many problems can result from this, besides the obvious one that the loose lid will damage the rotor and/or centrifuge. The securement of the rotor lid is desirable in order to prevent leakage of the material undergoing centrifugation. This is especially important where toxic and other biohazardous materials are concerned. If breakage occurs within the rotor chamber, the material under test may spill and/or release hazardous vapors. Such vapors may release into the atmosphere exposing laboratory personnel to harmful material. Additionally, leakage that escapes the rotor chamber can cause an imbalance in the rotor chamber which can result in spindle breakage or drive failure. Although this problem of failing to secure the rotor lid to the rotor assembly would seem to be preventable by careful attentiveness to laboratory procedures, this problem occurs much more often than would be expected.

In most of the prior art rotor assemblies, the rotor lid rests on top of the rotor body and is secured by a knob on top of the lid that is attached to a bolt or a stem that extends through a bore in the center of the lid and attaches to the rotor body or the centrifuge spindle hub. However, if the lid is not secured by the knob and bolt to the rotor or spindle hub, then the lid just rests on top of the rotor, leading to the problem described above. U.S. Pat. No. 4,850,951 to Cheng et al. discloses a lid retention apparatus for centrifuge rotor covers. In the apparatus, a lid rests on top of the rotor body and a bolt is used to hold the lid on the rotor. The bolt is engaged centrally of a knob on top of the lid and extends through a spacer, a bushing and is held to the lid by a key. The lid is placed on the rotor and the bolt engages with a female threaded aperature in the rotor. The invention comprised cantilevering a bushing from the lid down to the vicinity of the drive hub within the central aperature of the rotor body. This bushing provides a tighter-fit mating part that keeps the lid from easily wiggling out of the rotor.

It is the object of the present invention to provide a rotor lid that is capable of staying on the rotor body even when the lid has not been tightened down or secured.

SUMMARY OF THE INVENTION

The above objective has been achieved by a self-retaining rotor lid, which has a lip formed on an outer edge of the major side of the lid facing an open end of a rotor body. The lip is of a height so as to extend beyond the edge of the open end of the rotor body, and has a diameter that is nominally smaller than the diameter of the open end of the rotor body. This establishes a clearance between the lid and the rotor body that allows easy engagement of the lid to the rotor body, but that is small enough to prevent the lid from tilting. If the lid assembly was forced to one side against the edge of the opening in the rotor body, while the opposite side of the lid was lifted by a predictable force due to rotational imbalance, the section of the lip on the first side would pivot against the edge of the rotor opening and the section of the lip on the opposite side would bind against the edge of the opening as it was being lifted. Thus, the lid would rattle within the opening in the rotor body, but would not be thrown off.

The rotor lid of the present invention provides the main advantage of reducing damage to the lid, rotor or instrument due to an operator error of not tightening the lid down prior to operating the rotor assembly. Because the self-retaining lid of the present invention stays on the rotor body, this prevents having a direct path for the material undergoing centrifugation to escape, as well as the other undesired results described above.

BEST MODE FOR CARRYING OUT THE INVENTION

Figure 1:
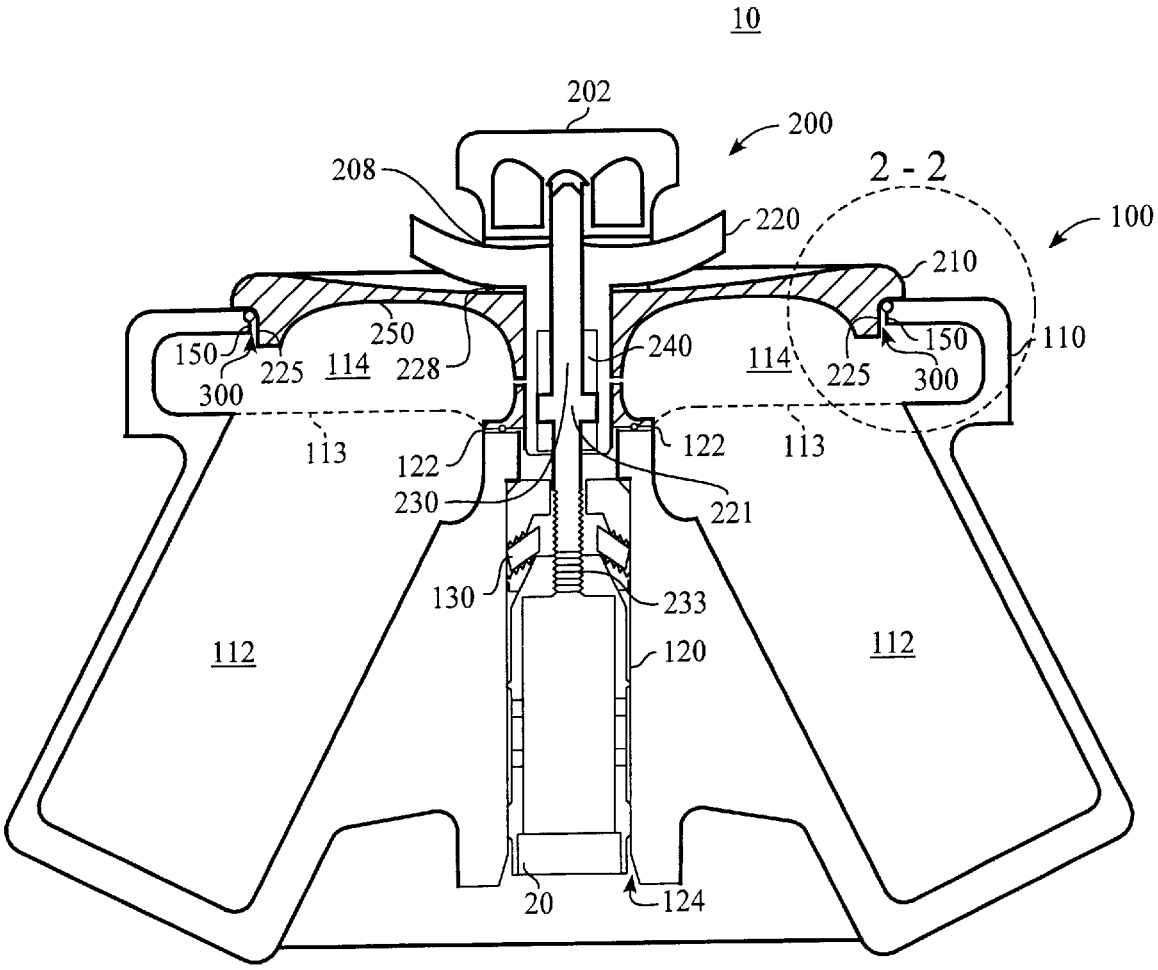
FIG. 1 is a cross sectional view of a rotor assembly employing the self-retaining lid of the present invention.

Referring to FIG. 1, a rotor assembly 10 comprises a rotor 100 and a rotor lid assembly 200 which seals the contents in the rotor during centrifugation. Rotor 100 comprises a rotor body 110 which has a rotor chamber consisting of a plurality of canister chambers 112 for receiving configuration sample containers, not shown, which hold the sample being centrifuged and an interior upper chamber 114. In FIG. 1, the separation between the canister chambers 112 and the interior upper chamber 114 is shown by a dashed line 113. Interior chamber 114 is the volume which remains within the rotor chamber after the insertion of the centrifugation containers. At the upper end of the rotor body 110 is an annular opening defined by an edge 150. The opening in the top of the rotor body 110 is intended to be covered by the lid assembly 200. Rotor body 110 includes an axial bore 120 formed though the spin axis of the rotor body, extending from an open end 122 within interior chamber 114 to an open end 124 at the bottom of the rotor body. Axial bore 120 includes one or more locking pins 130 which project into the interior volume of the axial bore. The rotor is preferably made of anodized aluminum, but may also be made of titanium or stainless steel. All of the metallic parts used in the rotor assembly are machined and then the parts are assembled.

Setting up the rotor assembly for a centrifugation run includes placing rotor 100 into a instrument chamber, not shown. The instrument chamber includes a spindle hub 20 which is received in the axial bore 120 of the rotor body 110. The inserting end of the spindle hub 20 is slotted to engage locking pins 130, thus locking the spindle hub into position relative to the rotor body. Spindle hub 20 is coupled to a drive motor, not shown, which provides the torque to spin the rotor.

Figure 3:
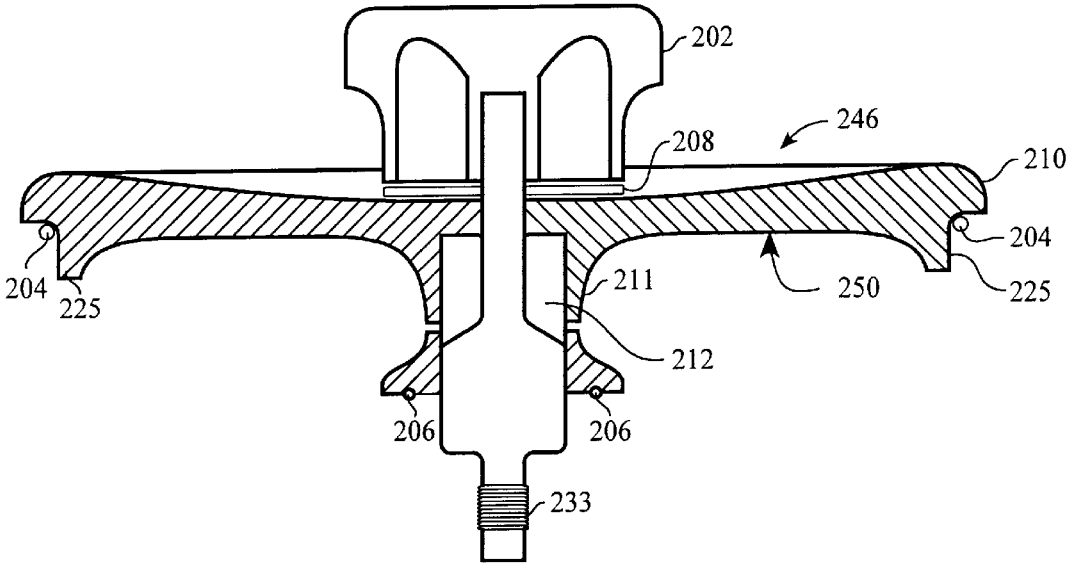
FIG. 3 is a cross sectional view of a single-locking lid version of the rotor lid assembly employing the self-retaining lid of the present invention.

With reference to FIGS. 1 and 3, the lid assembly 200 comprises the self-retaining lid 210 of the present invention, which has an upper major surface 246 and an opposed bottom major surface 250. The lid is preferably made of anodized aluminum, but may also be made of titanium or stainless steel. A neck portion 211 depends from the bottom major surface 250 of the lid 210. A bore 212 is formed through the lid 210, extending from upper surface 246 through the length of the neck portion 211. A gasket member 204, such as an O-ring, is disposed about the periphery of lid 210 to provide a seal with the rotor body 110. The length of the neck portion 211 is such that when a rotor is sealed by the cap assembly, a distal end of the neck portion contacts a surface of the open end 122 of the axial bore 120. A gasket 206 is disposed at the distal end of the neck portion 211 to provide a seal with the surface of the open end 122 when such contact occurs.

In FIG. 1, the lid assembly of the present invention is shown to be a bio-containment or dual-locking type of lid. In a dual-locking style of lid, a safety knob 220 is included in the assembly. The safety knob 220 can be made of stainless steel or of molded plastic and has opposed major surfaces and includes a shank 221 depending from the bottom surface of the safety knob 220 and the bore 240 extending from the mid-point to the end of the shank 221. A tie-down stem 230 is received within bore 240. The tie-down stem 230 is made of stainless steel and has a diameter that is less than the diameter of bore 240. Bore 240 narrows to a diameter that is the same of the diameter of the tie-down stem along a portion approximate to safety knob 220 in order to provide a slidable yet air-tight fit therebetween when a small amount of vacuum grease is applied. Tie-down stem 230 extends above upper surface 220 of the safety knob for attachment of a knob 202. Knob 202 is preferably made of a molded plastic in order to decrease its mass. The tie-down stem 230 includes a threaded end 233 distal to the knob 202. A washer seal 228 is disposed on the bottom surface of the safety knob 220 and fits around shank 221. A second washer seal 208 is disposed on a bottom surface of knob 202, and fits around the tie-down stem 230. These washers provide a seal when the lid assembly is in a locked-down position. As can be seen in FIG. 1, the safety knob presses down onto lid 210 and serves to provide a dual-locking function in conjunction with the knob 202. The dual-locking lid assembly permits the lid to remain in a locked-down configuration even when the tie-down stem is disengaged from the spindle hub. The self-retaining lid 210 of the present invention can also be used with a single locking lid, as shown in FIG. 3.

The self-retaining lid of the present invention 210 has a lip 225 formed on the outer edge of the bottom surface 250 of the lid 210. The bottom surface 250 of the lid is shaped in a curved or concave shape. The curvature of the bottom surface 250 of the lid helps to deflect any high pressure stray fluid from leaky bottles away from the sealing surface of the O-rings 204 and to direct the fluid back into the interior chamber 114 of the rotor assembly. This helps to keep the fluid material from leaking outside of the unlocked and unsealed lid.

Figure 2:
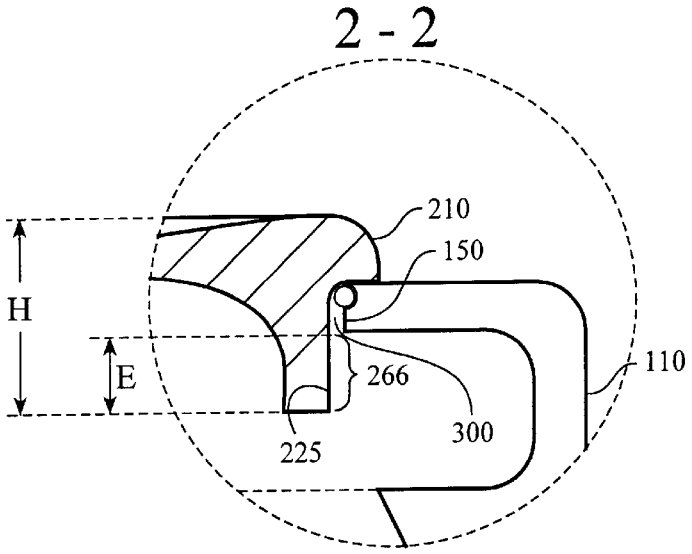
FIG. 2 is a magnified view of a portion of the apparatus of FIG. 1, seen at the circle 2—2.

With reference to FIGS. 1 and 2, the height of the lip 225 is designed so as to extend downwardly beyond the lowermost edge 150 of the open end of the rotor body. Additionally, the height of the lip, H, together with the central portion of the lid, is designed so that the center of mass of the lid assembly 200 is below the line of contact between the lid and the edge of the rotor assembly. The center of the lid has a stem contact which contacts the tie down stem 230. In FIG. 2, an "overhang" region 266 is seen to be the extent of lip 225 extending beyond edge 150, a distance E which is at least a few millimeters, say 3 millimeters and up to 1 centimeter or so. The distance E has been exaggerated in FIG. 2, compared to FIG. 1, for purposes of illustration. The lid assembly is designed so that the center of mass is located below the top of the rotor assembly, rather than above the rotor assembly, which assists in keeping the lid on the rotor assembly. Designing the top portion of the lid assembly 200 to have less mass, such as having knob 202 be made of a molded plastic, helps to lower the center of mass. If the center of mass of the lid assembly 200 is normally already below the line of contact between the lid 210 and the edge 150 of the rotor assembly, then the extent of the "overhang" region 266, the distance E, can be smaller because the lid assembly 200 would tend to remain inside the rotor assembly and would not tilt. However, if the center of mass is normally higher than that line of contact, the overhang region 266, distance E, must be greater in order to lower the center of mass of the lid assembly 200 and to force the lip 225 to contact the edge 150 to keep the lid on the rotor assembly in the event that the lid tilted.

Figure 4:
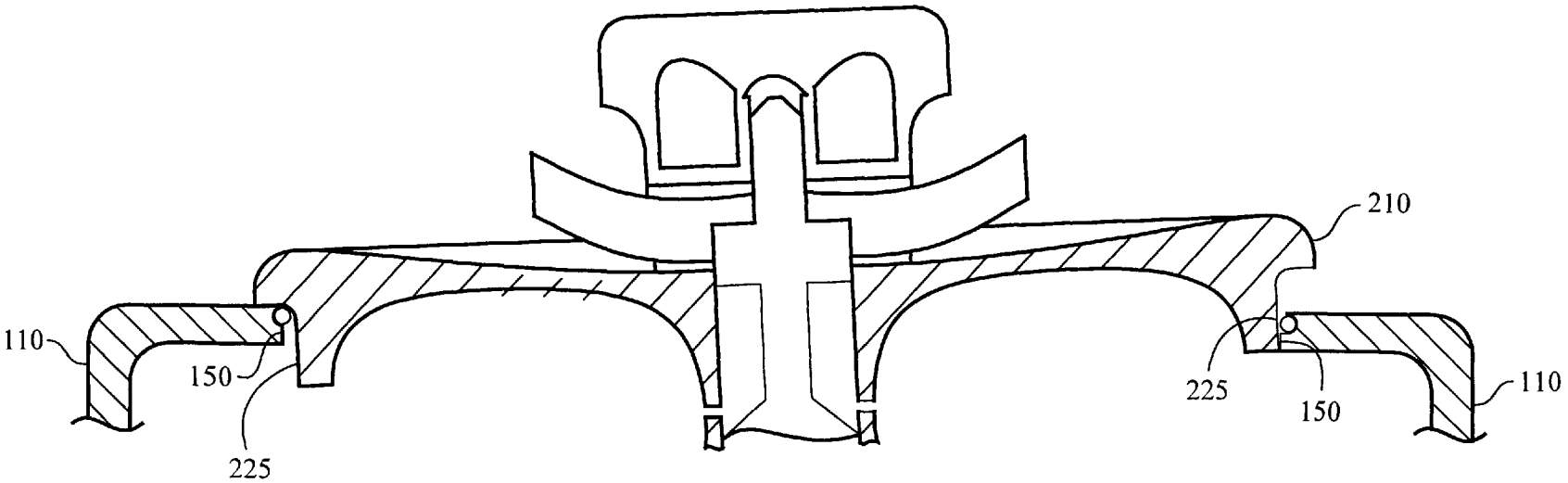
FIG. 4 is a cross sectional view of a portion of the apparatus of FIG. 1, with the lid tilted with respect to the rotor body.

The diameter of the lip 225 is nominally smaller than the diameter of the open end of the rotor body, thus establishing a clearance 300 therebetween. Ideally, the outer diameter of the lip is sized to approximately 0.020 inches smaller than the inside diameter of the open end of the rotor body. This clearance 300 is selected to allow easy engagement of the lid to the rotor body but also to prevent the lid from tilting. As shown in FIG. 4, if the center of mass of the lid assembly was to be above the line of contact between the lid 210 and the edge 150 of the rotor assembly, and if the lid 210 was to be forced to one side against the edge 150 of the rotor opening, while the opposite side of the lid (180° around) was being lifted by the predictable force due to rotational imbalance, the section of the lip 225 on the opposite side would bind against the edge 150 of the opening and this would prevent the lid from exiting the opening. In this way, even when the knob 202 and the safety knob 220 are not tied down to secure the lid, the lid would not exit the rotor body 110. It is likely that the lid would rattle inside of the rotor assembly, but because the lid is unable to tilt, due to the lip being blocked by the edge of the rotor opening, the lid will not fly off the rotor assembly. By incorporating the lid of the present invention into the rotor assembly, there will be fewer instances of lid, rotor, or instrument damage due to the operator error of not tightening down the lid before running the centrifuge.

What is claimed is:

1. A centrifuge rotor assembly comprising:

a centrifuge rotor having a body with an annular opening having a peripheral edge; and a self-retaining rotor closure for covering the opening of the rotor, wherein the self-retaining rotor closure comprises:

a lid having a first and a second major surface, with a lip formed on an outer edge of and extending downwardly from the second major surface, wherein the lid is adapted to cover the annular opening of the rotor, the lip being of a height so as to extend beyond the peripheral edge of the annular opening of the rotor body, the lip having an outer diameter that is smaller than a diameter of the annular opening of the rotor body establishing a clearance therebetween, the clearance being of a size that will allow engagement of the lid to the annular opening of the rotor body but will also prevent the lid from tilting out.

2. The centrifuge rotor assembly of claim 1, wherein the clearance is of a size to allow the lid to pivot on a point on the lid and hold against the peripheral edge of the annular opening on an opposite side of the lid when the opposite side is lifted.

3. The centrifuge rotor assembly of claim 1, wherein the self-retaining centrifuge rotor closure further comprises a first knob coupled to the center of the lid for securing the lid to the rotor body.

4. The centrifuge rotor assembly of claim 3, wherein the self-retaining centrifuge rotor closure further comprises a second knob cooperating with the knob to secure the lid to the rotor body, wherein the second knob is disposed coaxially to the first knob.

5. The centrifuge rotor assembly of claim 1, wherein the second major surface has a concave shape.

6. The centrifuge rotor assembly of claim 1, wherein the length of a portion of the lip extending beyond the peripheral edge of the annular opening is from about 3 mm to about 1 cm.

7. The centrifuge rotor assembly of claim 1, wherein the outer diameter of the lip is about 0.02 inches smaller than the inside diameter of the annular opening of the rotor body.

8. A centrifuge rotor assembly comprising:

a centrifuge rotor having a body with an annular opening having a peripheral edge; and a self-retaining rotor closure for covering the opening of the rotor, wherein the self-retaining rotor closure comprises:

a lid having a first and a second major surface, a neck portion depending from the second major surface of the lid along a central axis, the second major surface having a curved shape, a bore extending from the first major surface through the length of the neck portion, the neck portion having a channel extending from an exterior surface thereof to the bore, and a lip formed on an outer peripheral edge of the lid and extending from the second major surface thereof, wherein the lid is adapted to cover the annular opening of the rotor, the lip being of a height so as to extend at least a few millimeters beyond an edge of the annular opening of the rotor body, the lip having an outer diameter that is smaller than a diameter of the annular opening of the rotor establishing a clearance therebetween, the clearance being of a size that will allow engagement of the lid to the open end of the rotor body but will also prevent the lid from tilting out.

9. The centrifuge rotor assembly of claim 8, wherein the clearance is of a size to allow the lid to pivot on a point on the lid and hold against the peripheral edge of the annular opening on an opposite side of the lid when the opposite side is lifted.

10. The centrifuge rotor assembly of claim 8, wherein the self-retaining centrifuge rotor closure further comprises a first knob coupled to the center of the lid for securing the lid to the rotor body.

11. The centrifuge rotor assembly of claim 10, wherein the self-retaining centrifuge rotor closure further comprises a second knob cooperating with the first knob to secure the lid to the rotor body, wherein the second knob is disposed coaxially to the knob.

12. The centrifuge rotor assembly of claim 8, wherein the lid forms a part of a rotor lid assembly having a center of mass located below the edge of the annular opening of the rotor body.

13. In a rotor assembly of the type having (i) a rotor body having opposed upper and lower ends, the upper end having an opening into an interior chamber of the rotor body, the rotor body further having an axial first bore extending between an open end in the interior chamber and the lower end of the rotor body, (ii) a lid assembly to cover the opening of the upper end, the lid assembly including a self-retaining lid, and (iii) a spindle hub received in the axial first bore; the self-retaining lid comprising:

a pair of opposed major surfaces, including a first major surface and a second major surface, a neck portion depending from the second major surface along a central axis of the lid, the second major surface having a curved shape, a second bore extending from the first major surface through a length of the neck portion, the neck portion having a channel extending from an exterior surface thereof to the second bore, and a lip formed on an outer edge of and extending from the second major surface, the lip being of a height so as to extend beyond a lowermost edge of the opening of the upper end of the rotor body and the lip having an outer diameter that is smaller than a diameter of the edge of the opening of the upper end, establishing a clearance therebetween, the clearance being of a size to allow the lid to pivot on a point on the lid and hold against the edge of the opening of the upper end of the rotor body on an opposite side of the lid when the opposite side of the lid is lifted.

14. The self-retaining rotor lid of claim 13, wherein the self-retaining lid further comprises a first knob coupled to the center of the lid for securing the lid to the rotor body.

15. The self-retaining rotor lid of claim 14, wherein the self-retaining lid further comprises a second knob cooperating with the first knob to secure the lid to the rotor body, wherein the second knob is disposed coaxially to the knob.

16. The self-retaining rotor lid of claim 13, wherein the lid assembly has a center of mass located below the opening of the upper end of the rotor body.

* * * * *